United States Patent [19]

Paris

[11] Patent Number: 4,487,352

[45] Date of Patent: Dec. 11, 1984

[54] APPARATUS FOR ADJUSTING THE FEED LENGTH OF STRIP MATERIAL TO A PRESS

[75] Inventor: Edward S. Paris, Allison Park, Pa.

[73] Assignee: Vamco Machine and Tool, Inc., Pittsburgh, Pa.

[21] Appl. No.: 321,219

[22] Filed: Nov. 13, 1981

[51] Int. Cl.[3] ..... B65H 17/22

[52] U.S. Cl. ..... 226/142; 226/154; 226/158

[58] Field of Search ..... 226/141, 142, 158, 162, 226/154, 152; 74/24, 25

[56] References Cited

U.S. PATENT DOCUMENTS

| | | | |
|---|---|---|---|
| 2,262,915 | 11/1941 | Bobst | 226/142 |
| 2,514,261 | 7/1950 | Scheffey | 226/142 |
| 3,650,449 | 3/1972 | Mundus | 226/142 |
| 3,758,011 | 9/1973 | Portmann | 226/142 |
| 3,784,075 | 1/1974 | Portmann | 226/143 |
| 4,133,216 | 1/1979 | Gentile et al. | 74/384 |
| 4,138,913 | 2/1979 | Gentile | 83/236 |
| 4,285,453 | 8/1981 | Flamme et al. | 226/142 |
| 4,316,569 | 2/1982 | Gentile | 226/158 |

*Primary Examiner*—Billy J. Wilhite
*Assistant Examiner*—Scott J. Haugland
*Attorney, Agent, or Firm*—Stanley J. Price, Jr.; John M. Adams

[57] ABSTRACT

An input shaft of a press feed is rotated at a preselected speed and is drivingly connected to a cam that rotates the input shaft. Continuous rotation of the cam is converted to oscillating rotational movement of a cam follower through a preselected angle of rotation. The cam follower is nonrotatably connected to an output shaft that is connected by an adjustable drive link and gear arrangement to a driven feed roll. Oscillating rotational movement of the output shaft is transmitted to the driven feed roll to advance the driven feed roll in contact with the strip material through a preselected degree of rotation corresponding to a preselected feed length of the strip material to the press. The end of the drive link adjacent to the output shaft is movable relative to the output shaft. A universal adjusting device is connected to the drive link to move one end of the drive link relative to the end of the output shaft as the oscillating rotational movement of the output shaft is transmitted from the drive link to the driven feed roll. Moving the end of the drive link toward and away from the axis of rotation of the output shaft permits adjustments to be made in the feed length of the strip material. By making adjustments in the feed length while the feed roll is being driven, the press feeding operation continues without delay due to a change in the feed length.

11 Claims, 2 Drawing Figures

APPARATUS FOR ADJUSTING THE FEED LENGTH OF STRIP MATERIAL TO A PRESS

BACKGROUND OF THE INVENTION

1. Field of the Invention

This invention relates to apparatus for feeding strip material intermittently to a press and, more particularly, to apparatus for adjusting the feed lengths of strip material to the press as the feed roll is being driven, to thereby permit adjustments to be made to the feed length while the strip material is being fed.

2. Description of the Prior Art

It is the conventional practice in high speed automatic press operations to feed a strip of stock material from a coil to the dies of the press for punching, stamping, cutting or the like, at a preselected length of the stock material. The stock material must be fed from the coil in timed relation with the press operation so that before the dies contact the stock material, the stock material is moved into a final position by the die pilots as the feed rolls are released from engagement with the stock material. The stock material is then stationarily positioned between the dies. After the press operation is completed, the feed rolls are actuated to advance another length of the stock material to the press. Therefore, the feeding of the stock material to the press must be coordinated with each press operation so that, prior to each operation, a new segment of stock material is in position relative to the dies for the press.

U.S. Pat. Nos. 4,133,216 and 4,138,913 are examples of one type of feeding apparatus for power punch presses in which the feed rolls are drivingly connected by a plurality of meshing gears to an input shaft, which is drivingly connected to the punch press crank shaft. A geared cam drive receives continuous, uniform rotation from the input shaft and converts the rotation to a non-continuous step-by-step intermittent rotational movement to the driven feed roll. With this arrangement, the feed rolls advance intermittently through a 360° rotational cycle. During the dwell periods of the rotational cycle, the driven feed roll is not rotated and the punching operation is carried out. After the punching operation is completed, the feed rolls are again incrementally advanced so that another preselected length of stock material is passed through the press.

U.S. Pat. Nos. 3,758,011 and 3,784,075 are examples of other types of incremental feed apparatus that convert continuous rotation of a drive shaft to contrarotating oscillating movement of the feed rolls. The drive shaft is connected to a pair of meshing gears, one of which is arranged eccentrically and is connected to a lever that is rotated to-and-fro. Pivotal movement of the lever is transmitted to a shaft that is, in turn, coupled to the feed rolls. The oscillatory movement of the lever and shaft is transmitted to the feed rolls to generate a to-and-fro movement. The feed length can be changed by alternating the amplitude of the oscillatory movement of the feed rolls.

Synchronously with the to-and-fro movement of the feed rolls, the feed rolls move toward one another into a feed position and move away from one another into an idling position. The movement of the feed rolls between the feed and idling positions takes place at the point where the feed rolls change directions of oscillation. A holding mechanism for the work piece is actuated when the feed rolls move from their feed position into their idling position and is deactuated when the rollers move from their idling position into the feed position.

It is also known to make adjustments in the feed lengths of the stock material to the press, as disclosed in U.S. patent application Ser. No. 182,463, now U.S. Pat. No. 4,316,569, where a link member connects an oscillating output shaft to a driven feed roll. The end of the link member adjacent to the output shaft is movable linearly in a direction toward or away from the axis of rotation of the output shaft. The distance of the end of the link member from the axis of rotation of the output shaft determines the degree of movement of the link member and, accordingly, the degree of rotation of the driven feed roll and the feed length of the strip material. A spring biased adjusting member is movable into and out of connection with the end of the link member, so as to selectively move the end of the link member relative to the axis of rotation of the output shaft. Prior to each adjustment in the length, the transmission of rotation to the driven feed roll must be interrupted to permit engagement of the adjusting device to the link member. Once the connection is made and the link member is moved to a selected position, the adjusting device is disconnected and the transmission of rotation to the driven feed roll is again intiated.

While it is known to make adjustments in the feed length, the known devices do not efficiently permit adjustments to be made as rotation is transmitted to the driven feed rolls to provide an instantaneous readout once the adjustment is made of the length of the strips being fed to the press. Therefore, there is need to provide apparatus which permits as in motion adjustment to be made to the feed length as the feed roll intermittently feeds strip material to the press.

SUMMARY OF THE INVENTION

In accordance with the present invention, there is provided feeding apparatus for intermittently feeding strip material in preselected lengths that includes an input shaft supported for rotation at a continuous preselected speed. An output shaft has a first end portion and a second end portion. Drive means drivingly connects the output shaft first end portion to the input shaft to generate oscillating rotational movement of the output shaft through a preselected angle of rotation. Feed means intermittently feeds preselected lengths of the strip material in a selected direction. Rotation transmission means is drivingly connected at one end to the output shaft second end portion and at another end to the feed means. The rotation transmission means is operable in response to the oscillatory movement of the output shaft to transmit oscillatory rotational movement to the feed means to intermittently advance preselected lengths of strip material. Support means adjustably supports the rotation transmission means relative to the output shaft second end portion. Adjusting means is connected to the rotation transmission means for selectively moving one end of the rotation transmission means on the support means relative to the output shaft second end portion. The adjusting means is operable to move the rotation transmission means on the support means to adjust the feed length of the strip material as the strip material is being fed.

Accordingly, the principal object of the present invention is to provide in a feeding apparatus means for adjusting the feed length of a driven feed roll as the strip material is fed to a press.

Another object of the present invention is to provide in a strip feeding machine apparatus for instantaneously indicating a change in the feed length of the strip material to a press while the strip material continues to be fed to the press.

A further object of the present invention is to provide in a cam feed press universal in motion feed adjustment without interrupting the feed of strip material to the press.

These and other objects of the present invention will be more completely disclosed and described in the following specification, the accompanying drawings and the appended claims.

DESCRIPTION OF THE PREFERRED EMBODIMENT

Figure 2:
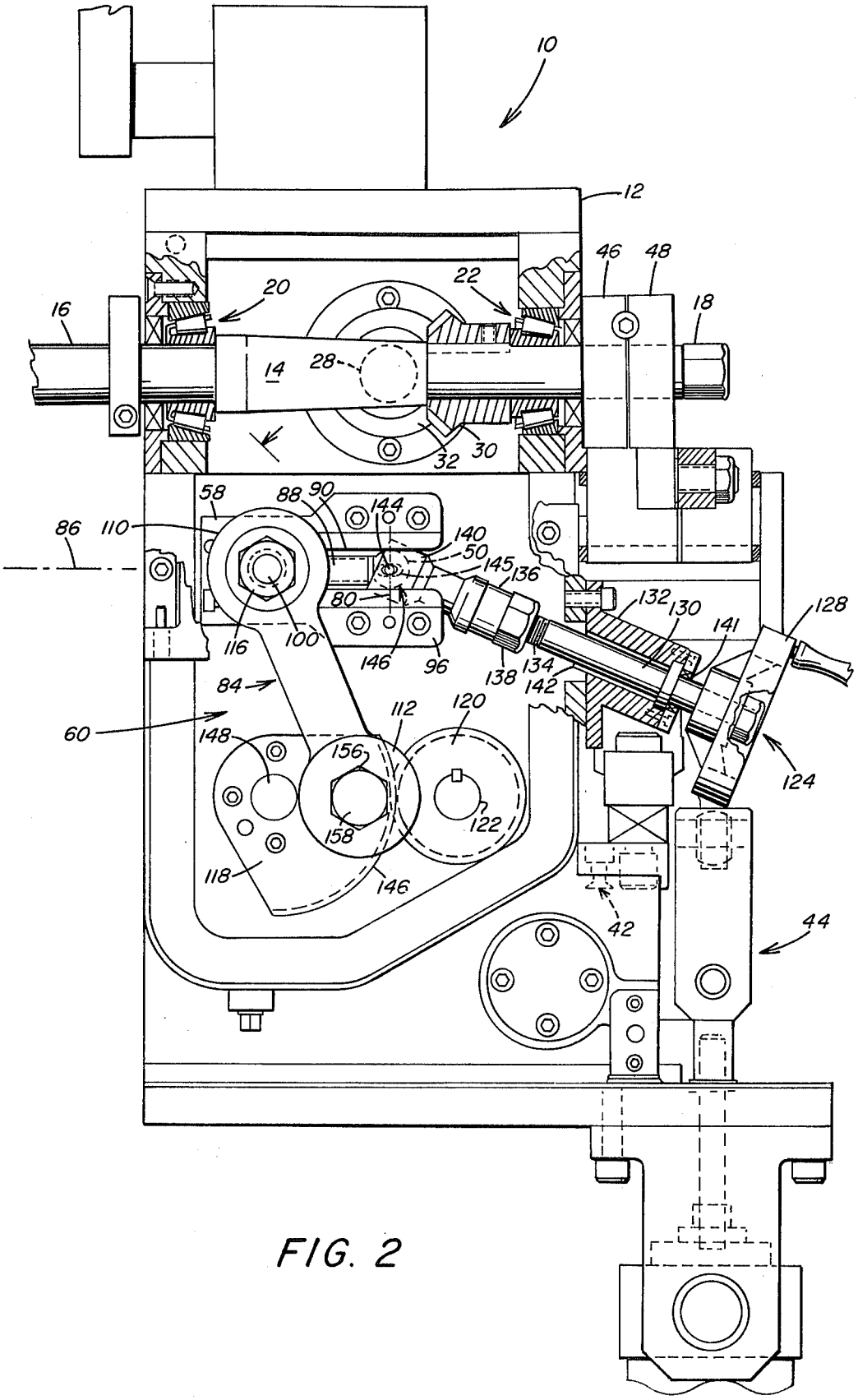
FIG. 2 is a fragmentary view, taken along the line II—II of FIG. 1, illustrating the drive connection of an output shaft through a linkage mechanism to the driven feed roll with means for adjusting the length of the strip material fed by the feed roll to a press during the feeding operation.

Referring to the drawings, and particularly FIG. 2, there is illustrated apparatus generally designated by the numeral 10 for feeding a workpiece, such as continuous strip or stock material from a reel to a power operated press, as for example, a press for stamping, punching, cutting or the like, of preselected lengths of material from the workpiece. The apparatus 10 includes a suitable housing 12 and a first powered input shaft 14 rotatably supported at its opposite end portions 16 and 18 by conventional bearing assemblies, generally designated by the numerals 20 and 22. The input shaft 14 is drivingly connected to a crank shaft (not shown) of the press in a manner as illustrated in U.S. Pat. No. 4,138,913. Rotation of the crank shaft is transmitted to the input shaft 14 to rotate the input shaft at a continuous preselected speed.

Figure 1:
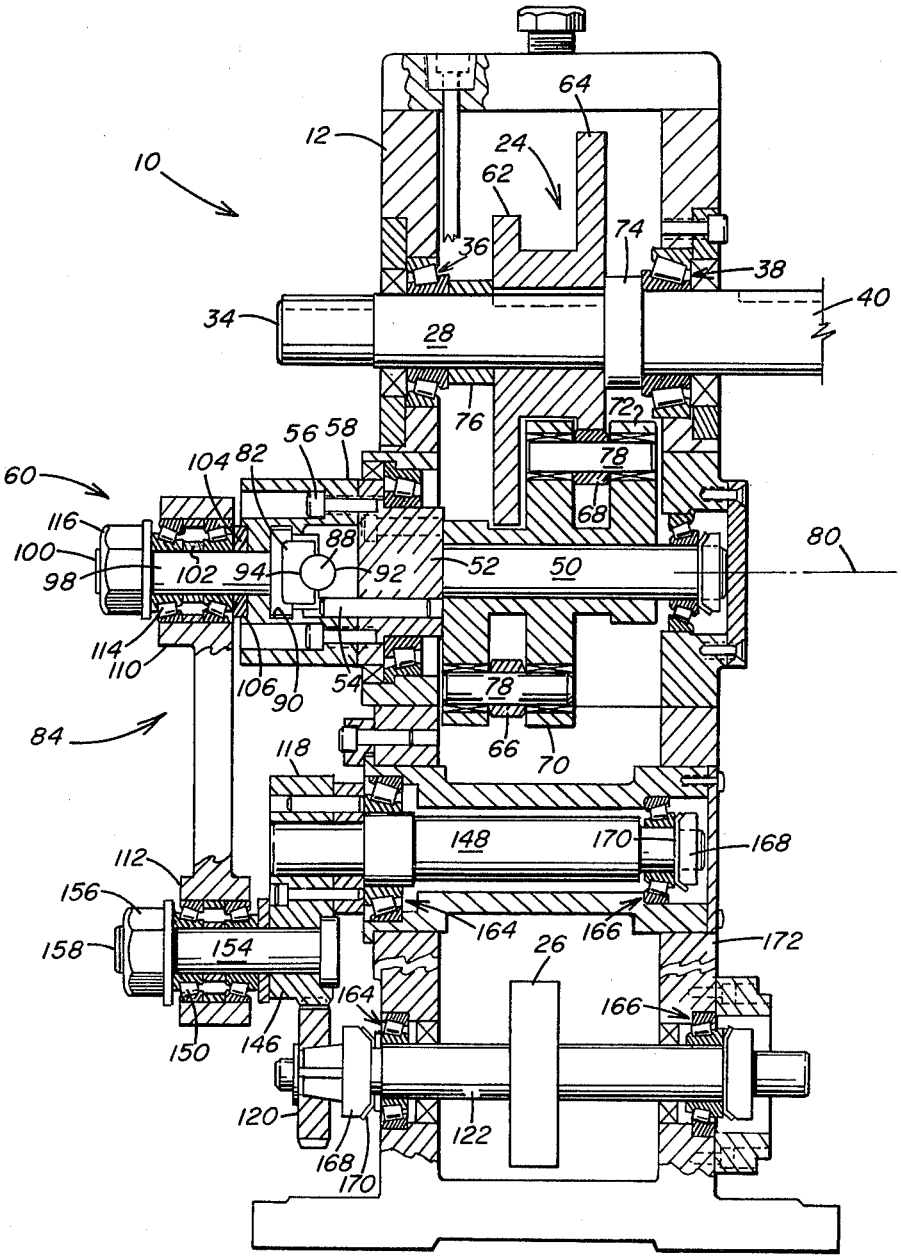
FIG. 1 is a partial sectional fragmentary view, in side elevation, of a cam feed apparatus for drivingly connecting an input shaft to a feed roll to generate a preselected degree of rotation of the feed roll for a selected feed length of strip material to a press.

Continuous rotation of the input shaft 14 is transmitted by a cam feed mechanism generally designated by the numeral 24 in FIG. 1 to a driven feed roll 26. The driven feed roll 26 is intermittently rotated to advance preselected lengths of stock material at a preselected speed to a press where the stock material is desirably treated, that is punched, stamped, cut or the like. The driven feed roll 26 is associated with an idler feed roll (not shown) positioned in overlying relation with the stock material caught between the feed and idler rolls. The rotary motion of the input shaft 14 is converted by the cam feed mechanism 24 to generate noncontinuous intermittent, oscillating rotation of the driven feed roll 26 through a preselected degree of rotation to intermittently feed preselected lengths of the stock material to the press.

A second powered input shaft 28 is positioned at a right angle with respect to the first powered input shaft 14. The first powered input shaft 14 is connected to the second powered input shaft 28 by a pair of meshing gears 30 and 32. Gear 30 is nonrotatably connected to the intermittent portion of the input shaft 14, and gear 32 is nonrotatably connected to a first end 34 of input shaft 28. The input shaft 28 is also rotatably supported in the machine housing 12 by conventional bearing assemblies 36 and 38. The input shaft 28 includes a second end portion 40 that extends from the rear of the housing 12.

Associated with the intermittent feed apparatus 10 is a material clamping mechanism generally designated by the numeral 42 and a feed release mechanism generally designated by the numeral 44 in FIG. 2. The material clamping mechanism 42 is actuated to prevent movement of the stock material as the driven feed roll 26 is rotated back to the initial feed position. When the driven feed roll 26 has rotated counterclockwise through a preselected angle of rotation, the clamping mechanism 42 is released from engagement with the stock material and the driven feed roll 26 and the idler roll are moved back into driving arrangement with the stock material for feeding another increment of stock material to the press.

The mechanisms 42 and 44 are driven by a clamp release cam 46 and a roll release cam 48, illustrated in FIG. 2. The cams 46 and 48 are adjustably, nonrotatably connected to the first powered input shaft 14. The operations of the cams 46 and 48 to synchronously feed the stock material with the engagement of the feed roll 26 and the idler roll with the stock material and release of the clamping mechanism 42 from engagement with the stock materials is discussed in greater detail in U.S. patent application Ser. No. 182,463 and is beyond the scope of the present invention.

The second powered input shaft 28 is continuously rotated at a preselected speed. The continuous rotation of the shaft 28 is converted by the cam feed mechanism 24 to oscillating rotational movement of an output shaft 50. The output shaft 50 is positioned in spaced parallel relation to the input shaft 28.

The output shaft 50 includes an enlarged end portion 52 which is nonrotatably connected by a plurality of dowel pins 54 and cap screws 56 to a transfer arm 58 of a linkage generally designated by the numeral 60. The linkage 60 is operable to transmit the oscillating movement of the output shaft 50 to the driven feed roll 26.

The cam feed mechanism 24 includes a pair of radial conjugate cams 62 and 64 that are preloaded against a pair of cam followers 66 and 68. The cam followers 66 and 68 are rotatably mounted on a pair of yoke members 70 and 72. The cams 62 and 64 have a preselected configuration to convert the continuous rotation of the second powered input shaft 28 to oscillating rotational movement of the output shaft 50. The cams 62 and 64 are non-rotatably connected to the intermittent portion of the second input shaft 28 and are maintained in a fixed axial position thereon by a shaft collar 74 and a cam spacer 76. Each of the cam followers 66 and 68 is mounted on a pin 78, which is rotatably retained in the respective yoke members 70 and 72 to permit rotation of the followers 66 and 68 as the cam followers 66 and 68 move on the peripheral surfaces of the cams 62 and 64.

The yoke members 70 and 72 maintain the cam followers 66 and 68 in contact with the peripheral surface of the cams 62 and 64. Each of the cams 62 and 64 has a corresponding configuration to generate oscillating rotational movement of the yoke members 70 and 72. As a result, the output shaft 50 is oscillated through a preselected angle. As for example, the cam followers 66 and 68 follow the surface of the cams 62 and 64 during one revolution of the input shaft 28, and the yoke members 70 and 72 rotate from an initial position through a preselected angle, as for example, an angle of 60°.

The yoke members 70 and 72 and the output shaft 50 stop during a first dwell period of rotation of the cams 62 and 64 and then resume rotation in the opposite direction through a corresponding angle, as for example, an angle of 60°. The yoke members 70 and 72 and the output shaft 50 return to their initial starting position and are stopped during a second dwell period of rotation of the cams 62 and 64. By providing a pair of cams 62 and 64, the inertia of the moving stock material generated by the acceleration of the stock material from an initial rest position to a maximum feed rate and then decelerating the stock material from the maximum feed rate to the rest position is compensated to maintain constant contact between the cams 62 and 64 and the cam followers 66 and 68. This arrangement assures zero backlash during each rotational cycle.

The yoke members 70 and 72 and the output shaft 50 oscillate from an initial position through a preselected angle and then back to the same angle to the initial position upon each revolution of the cams 62 and 64. Thus, as the cams 62 and 64 continuously rotate, the cam followers 66 and 68 together with the yoke members 70 and 72 and the output shaft 50 oscillate back and forth through a preselected angle. At the end of each angle of rotation, the yoke members 70 and 72 experience a dwell period in which the yoke members 70 and 72 do not move.

The oscillating movement of the output shaft 50 is transmitted by the linkage assembly 60 to the driven feed rolls 26. The transfer arm 58 overlies an axis of rotation 80 of the output shaft 50. The transfer arm 58 slidably supports a slide block 82 that is connected to one end of a drive link generally designated by the numeral 84. The transfer arm 58 supports the slide block 82 for slidable movement along an axis 86 of an adjusting screw 88. The axis 86 of the adjusting screw is transversely aligned with the axis of rotation 80 of the output shaft 50.

The transfer arm 58 has a longitudinally extending recessed portion 90 aligned with the adjusting screw axis 86. The slide block 82 is longitudinally movable in the recessed portion 90. The recessed portion 90 includes a radial groove 92 for receiving the adjusting screw 88. Positioned opposite the radial groove 92 is a threaded radial groove 94 in the slide block 82 for threadedly receiving the adjusting screw 88. The adjusting screw 88 is rotatably supported at one end portion in a bearing block 96 which is secured to the transfer arm 58. The adjusting screw 88 is rotatable relative to the transfer arm 58 but is restrained from axial movement relative to the transfer arm 58. Upon rotation of the adjusting screw 88 in a preselected direction, the slide block 82 moves longitudinally in the recessed portion 90 to a preselected position on the transfer arm 58.

A shaft 98 having a threaded end 100 is formed integral with the slide block 82 and extends outwardly therefrom. A clamp bushing 102 is positioned on the shaft 98. The clamp bushing 102 includes a plate end portion 104 that is slidable in a longitudinally extending recessed portion 106 of the transfer arm 58. The recessed portion 106 is positioned parallel to the recessed portion 90 on the slide block 82 where the recessed portion 106 extends the length of the recessed portion 90.

The drive link 84 includes a first end portion 110 and a second end portion 112. The first end portion 110 has a bore therethrough in which is positioned a bearing 114. The bearing 114 is positioned on the shaft portion 108. The drive link first end portion 110 is retained on the shaft portion 108 by a nut 116 that threadedly engages the shaft threaded end to maintain the bearing 114 on the transfer arm 58. Thus, the slide block 82 is retained in a preselected position on the transfer arm 58 relative to the point of intersection of adjusting screw axis 86 and the rotational axis 80 of output shaft 50.

The drive link second end portion 112 is connected through a pair of meshing gears 118 and 120 to a shaft 122 of the driven feed roll 26. With this arrangement, the meshing gears 118 and 120 transmit oscillating movement of the drive link 84 to the shaft 122 of the driven feed roll 26. The oscillating rotational movement of the output shaft 50 is transmitted to the driven feed roll 26 to thereby rotate the driven feed roll 26 through a preselected angle corresponding to a preselected feed length of the stock material to be fed to a press.

The length of travel of the drive link 84 generated by the oscillating rotational movement of the output shaft 50 is adjustable to provide a preselected degree of rotation of the driven feed roll 26 corresponding to a preselected feed length, as a result of the fixed angular rotation of the output shaft 50. The length of travel of the drive link 84 and accordingly, the degree of rotation of the driven feel roll 26 and the resultant feed length increases with an increase in the distance between the connection of the drive link first end portion 110 on the transfer arm 58 and the rotational axis 80 of the output shaft 50.

In FIG. 2, the drive link first end portion 110 is connected to the transfer arm 58 in a position substantially spaced from the rotational axis 80 to provide substantially a maximum feed length. Accordingly, to reduce the feed length, the drive link first end portion 110 is moved on the transfer arm 58 to a position closer to the rotational axis 80. In this manner, the feed length of the stock material to the press is substantially, infinitely adjustable between these limits and is accomplished by rotation in a preselected direction of the adjusting screw 88.

To make adjustments in the feed length, the nut 116 is loosened on the shaft threaded end portion 112 to thereby remove the clamp bushing plate end portion 104 from frictional engagement with the surface of the transfer arm 58 in the recessed portion 90. The adjusting screw 88 is then rotated in a preselected direction on the transfer arm 58 by an actuating device generally designated by the numeral 124 in FIG. 2. The actuating device 124 includes a hand wheel 128 nonrotatably connected to the end of a shaft 130 that is positioned for rotational movement in a block 132 that is secured to the housing 12. The hand wheel 128 can be substituted for a suitable remote control actuator, such as a motor for rotating shaft 130.

The opposite end of the shaft 130 includes a threaded end portion 134. A coupling 136 having a threaded bore for receiving the threaded end portion 134 is maintained in a preselected position thereon by a lock nut 138. The opposite end of the coupling 136 has a socket end portion 140. The shaft 130 is rotatably supported within a lubricated bushing 142 which is retained within the block 132 and is suitably sealed at 141. The socket end portion 140 of the coupling 136 is connected to the head of the adjusting screw 88 by a universal-type connection 146. The universal-type connection 146 includes a pin 144 extending through an enlarged slot 145 in the spherical head of the adjusting screw 88. The ends of the pin 144 are retained in holes in the socket end portion 140 of the coupling 136.

The pin 144 is positioned transverse to the longitudinal axis of the adjusting screw 88. In addition, the pin 144 is positioned in the horizontal plane of the rotational axis 80 of the output shaft 50. The slot 145 is slightly larger than the pin 144, and therefore the pin 144 is free to move angularly in the slot 145 a sufficient degree to assure transmission of rotation from the shaft 130 to adjusting screw 88. Thus, the pin 144 connects the coupling 136 to the adjusting screw 88 but does not carry any load, preventing wear of the pin 144. This is particularly advantageous for adjusting the total length of the screw 88 and coupling 136 to the required length, maintaining the pin 144 in the plane of the shaft rotational axis 86.

The total length of the combined shaft 130 and coupling 136 is adjusted by extending and retracting the shaft threaded end portion 134 out of and into the threaded end of coupling 136. The lock nut 138 maintains the coupling 136 in the desired position on the shaft 130. In this manner the combined shaft 130 and coupling 136 has a range of pivotal movement of about 45° about the pin 144.

Thus, with the above described arrangement, the length of travel of the drive link 84 is adjusted by adjusting the position of the drive link end portion 110 on the transfer arm 58. The adjusting screw 88 is rotated by the actuating device 124 to adjust the position of the drive link end portion 110 on the transfer arm 58 while intermittent oscillating rotation is being transmitted from the shaft 50 to the driven feed roll 26. The adjusting screw 88 is rotated by rotating the hand wheel 128. Rotation of the hand wheel is transmitted through the coupling 136 and the connection of the pin 144 to the end of the adjusting screw 88. Accordingly, the hand wheel 128 is rotated in a preselected direction and in this manner adjustments, for example, in increments of 0.001 inches can be made between 0 to 3 inches.

The slide block 82 together with the drive link end portion 110 are moved laterally to a preselected position on the transfer arm 58 with respect to the rotational axis 80 of the output shaft 50 by rotation of hand wheel 128. Once the slide block 82 and the drive end portion 110 have been moved to a preselected position on the transfer arm 58, corresponding to a preselected feed length, the machine is stopped and the nut 116 is tightened on the threaded end 100. The initial adjusting of the position of the slide block 82 on the transfer arm 58 takes place while the feed roll 26 is being driven. When the desired feed length setting is obtained, the setting is fixed by tightening of the nut 116 on the threaded end 100 of shaft 98.

In this manner an instantaneous indication of feed length for the driven feed roll 26 is obtained during the feeding operation. The feeding operation does not have to be stopped and started after each adjustment in the feed length. Adjusting the feed length during the feeding operation is desirable in order to determine the effect of the feed rate on the feed length. It is well known that variations occur in a feed length setting from one feed rate to another. However, with the present invention the feed length is set while the strip material is fed to the press at the desired feed rate. This permits precise control of the feed length at the desired feed rate.

Once the desired feed length is obtained, the plate end portion 104 of the clamping bushing 102 is returned to frictional engagement with the transfer arm 58 to retain the drive link end portion 100 in the selected position on the transfer arm 58. This arrangement provides a very precise and easily obtained adjustment in the feed length of the driven feed roll 26. The adjustment is quickly accomplished avoiding down-time of the machine and eliminates the need for starting and stopping the machine after each adjustment to assure that the feed roll 26 is feeding at the desired feed length.

As further illustrated in FIGS. 1 and 2, the drive link second end portion 112 is eccentrically connected adjacent to the periphery of the gear 118, which is illustrated in FIG. 2 as a gear segment having gear teeth only on a radial segment 146. The radial gear segment 146 is arranged to mesh with the teeth of the gear 120. However, it should be understood that the gear to which the drive link 84 is connected may have gear teeth around its entire periphery. It should also be understood that the drive connection of the drive link 84 to the driven feed roll 26 may include a plurality of meshing gears, for example, a set of four meshing gears as opposed to a pair of meshing gears as illustrated in FIG. 2.

The gear segment 146 is rotatably positioned on a gear shaft 148. The gear shaft 148 is supported by the housing 12. As illustrated in FIG. 2, the point of connection of the drive link second end portion 112 is horizontally aligned with the axes of rotation of the gear shaft 148 and the feed roll shaft 122 that supports the other gear 120. The drive link second end portion 112 is, in turn, connected eccentrically to the periphery of the gear segment 146 by a pin 154, which is rotatably supported by a bearing assembly 150.

The drive link second end portion 112 abuts the top surface of the gear segment 146 and is maintained in a fixed axial position thereon by threaded engagement of a nut 156 with a threaded end 158 of the pin 154. The pin 154 includes an opposite enlarged end portion that engages the undersurface of the gear segment 146. The gear segment 146 meshes with the gear 120 that is nonrotatably connected to the shaft 122 of the driven feed roll 26. The gear segment 146 is mounted in a manner as described in detail in U.S. patent application Ser. No. 182,463 to be moved laterally relative to the gear 120. This allows the gear teeth of the gear segment 146 to be moved into and out of precise engagement with the gear teeth of the gear 120. Thus, any backlash existing between the meshing gears 146 and 120 can be removed. By removing backlash and play between meshing gears 146 and 120, lost motion is removed in the transmission of rotation from the linkage 60 to the driven feed roll 26.

The gear 120 that rotates the shaft 122 of the driven feed roll 26 is drivingly connected to the gear segment 146. However, it should be understood that the axis of rotation of the gear shaft 122 is positioned in the same horizontal plane and parallel to the axis of the pin 154 that connects the drive link 84 to the gear segment 146. For purposes of clarity of illustration, in FIG. 1, the shaft 122 is shown displaced from its coplanar relationship with the pin 154 in order to more clearly illustrate the transmission of rotation from the input shaft 28 to the output shaft 50 through the linkage 60 to the driven feel roll 26. Therefore, in FIG. 1, the shaft 122 and the driven feed roll 26 are shown in a position lowered from the FIG. 2 position in the housing.

The shaft 122 is rotatably mounted at its opposite end portions by a pair of bearing assemblies generally designated by the numerals 164 and 166 in the housing 12.

The bearing assembly 166 is retained in a preselected axial position on the shaft 122 by combination bearing nut 168 and bearing washer 170. A mounting ring 172 is secured to the housing 12 and retains the bearing assembly 166 in place on the end of the shaft 122 opposite the end of the shaft 122 that carries the gear 120. Thus, with the above-described arrangement, the angular movement of the driven feed roll 26 is adjustable by adjusting the position of the slide block 82 on the transfer arm 58 by rotation of the hand wheel 128, shaft 130 and coupling 136 to, in turn, adjust the length of travel of the drive link 84 and change the feed length.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Feeding apparatus for intermittently feeding strip material in preselected lengths comprising, an input shaft supported for rotation at a continuous preselected speed, an output shaft having a first end portion and a second end portion, said output shaft having an axis of rotation, drive means drivingly connecting said output shaft first end portion to said input shaft for generating oscillating rotational movement of said output shaft through a preselected angle of rotation, feed means for intermittently feeding preselected lengths of the strip material in a selected direction, rotation transmission means drivingly connected at one end to said output shaft second end portion and at another end to said feed means, said rotation transmission means being movable in response to the oscillating movement of said output shaft to transmit oscillating rotational movement to said feed means to intermittently advance preselected lengths of strip material, support means connected to said output shaft second end portion for adjustably supporting said rotation transmission means one end for movement relative to said output shaft second end portion, said support means overlying said output shaft axis of rotation, adjusting means including an adjusting screw rotatably mounted on said support means and connected to said rotation transmission means for selectively moving said one end of said rotation transmission means on said support means relative to said output shaft second end portion upon rotation of said adjusting screw, said adjusting screw having a rotational axis transversely aligned with and intersecting said output shaft axis of rotation, said adjusting screw being operable upon rotation to move said rotation transmission means one end along said adjusting screw rotational axis to a preselected position relative to said output shaft axis of rotation on said support means to adjust the feed length of the strip material as the strip material is being fed, actuating means for rotating said adjusting screw to move said one end of said rotation transmission means to a preselected position on said support means corresponding to a preselected feed length of the strip material, and said actuating means being connected to said adjusting screw at a point positioned on said adjusting screw rotational axis and overlying said output shaft axis of rotation for movement independently of rotation of said output shaft so as not to rotate with said output shaft as the strip material is being fed.

2. Feeding apparatus as set forth in claim 1 which includes, said output shaft axis of rotation positioned in a horizontal plane, said actuating means having an end portion positioned adjacent to said output shaft axis, universal means for connecting said actuating means to said adjusting screw for transmitting rotation from said actuating means to said adjusting screw, and said universal means being connected to said adjusting screw at a point lying in said horizontal plane.

3. Feeding apparatus as set forth in claim 2 which includes, said universal means having a pivotal axis positioned in parallel relation with said output shaft axis in said horizontal plane.

4. Feeding apparatus as set forth in claim 1 in which, said rotation transmission means includes a first member and a second member, said first member being connected to said support means, said second member being connected to said feed means, and said support means including a shaft connected to said first member and carried on said adjusting screw for linear movement upon rotation of said adjusting screw to move said second member a preselected distance from said output shaft.

5. Feeding apparatus as set forth in claim 1 in which, said adjusting screw is rotatably supported on said output shaft second end portion adjacent said transmission means, said support means including a slide block slidably positioned on said adjusting screw and connected to said rotation transmission means, and said rotation transmission means being linearly movable with said slide block upon rotation of said adjusting screw relative to said output shaft second end portion such that upon rotation of said actuating means to rotate said adjusting screw in a selected direction said rotation transmission means moves toward and away from said output shaft second end portion.

6. Feeding apparatus as set forth in claim 1 in which, said rotation transmission means includes a linkage for selectively positioning the connection of said output shaft to said feed means to provide a preselected length of travel of said linkage corresponding to a preselected feed length, said linkage including an end portion connected to said support means for linear movement relative to said output shaft second end portion, said adjusting screw being rotatably supported in a fixed axial position on said support means adjacent to said output shaft second end portion, and coupling means for connecting said adjusting screw to said linkage end portion so that rotation of said adjusting screw in a preselected direction generates linear movement of said linkage end portion toward and away from said output shaft second end portion to adjust the length of travel of said linkage.

7. Feeding apparatus as set forth in claim 1 in which said actuating means includes, a rotatable shaft having an actuator end portion and a threaded end portion, a coupling having a first end portion threadedly connected to said shaft threaded end portion and a second end portion, and universal means for connecting said coupling second end portion to said adjusting screw for linearly advancing said rotation transmission means on said support means relative to said output shaft second end portion upon rotation of said shaft.

8. Feeding apparatus for intermittently feeding strip material in preselected lengths comprising, an input shaft supported for rotation at a continuous preselected speed, an output shaft having a first end portion and a second end portion, drive means drivingly connecting said output shaft first end portion to said input shaft for generating oscillating rotational movement of said output shaft through a preselected angle of rotation, feed means for intermittently feeding preselected lengths of the strip material in a selected direction, rotation transmission means drivingly connected at one end to said output shaft second end portion and at another end to said feed means, said rotation transmission means being movable in response to the oscillating movement of said output shaft to transmit oscillating rotational movement to said feed means to intermittently advance preselected lengths of strip material, support means connected to said output shaft second end portion for adjustably supporting said rotation transmission means one end for movement relative to said output shaft second end portion, adjusting means including an adjusting screw rotatably mounted on said support means and connected to said rotation transmission means for selectively moving said one end of said rotation transmission means on said support means relative to said output shaft second end portion upon rotation of said adjusting screw, a rotatable shaft having an actuator end portion and a threaded end portion, a coupling having a first end portion threadedly connected to said shaft threaded end portion and a second end portion, universal means for connecting said coupling second end portion to said adjusting screw for linearly advancing said rotation transmission means to a preselected position on said support means corresponding to a preselected feed length of the strip material as the strip material is being fed upon rotation of said rotatable shaft, said coupling means includes a coupling member having a first end portion adjustably connected to said shaft threaded end portion, said coupling member including a second end portion having a socket adapted to receive said adjusting screw, a pin member extending through said adjusting screw and having end portions retained in said socket to connect said coupling to said adjusting screw, and said adjusting screw being rotatably supported on said support means such that rotation of said rotatable shaft and said coupling is transmitted to said adjusting screw to generate linear movement of said rotation transmission means.

9. Feeding apparatus as set forth in claim 1 in which, said adjusting screw is rotatably supported relative to said rotation transmission means, said adjusting screw being rotatably connected to said rotation transmission means, and said adjusting means being rotatable and restrained from axial movement relative to said rotation transmission means.

10. Feeding apparatus as set forth in claim 1 in which, said rotation transmission means includes a first end portion linearly movable on said support means and a second end portion connected to said feed means, said first end portion being linearly movable relative to said output shaft second end portion upon rotation of said actuating means, said actuating means being rotatably positioned adjacent to said first end portion, and said adjusting screw being connected to said first end portion and said actuating means such that rotation of said actuating means rotates said adjusting screw to linearly advance said first end portion relative to said output shaft second end portion.

11. Feeding apparatus for intermittently feeding strip material in preselected lengths comprising, drive means for generating oscillating rotational movement through a preselected angle of rotation, said drive means having an axis of rotation, feed means for intermittently feeding preselected lengths of strip material in a selected direction, a drive linkage positioned between said drive means and said feed means, said drive linkage having a first end portion and a second end portion, means for connecting said drive linkage second end portion to said feed means, an adjusting screw rotatably supported on said drive means and retained in a fixed axial position transversely aligned with the axis of rotation of said drive means, said adjusting screw having a rotational axis transversely aligned with and intersecting said drive means axis of rotation, a slide block positioned for linear movement on said adjusting screw rotational axis relative to said axis of rotation of said drive means upon rotation of said adjusting screw, said drive linkage first end portion being connected to said slide block for linear movement with said slide block upon rotation of said adjusting screw along said adjusting screw rotational axis to a preselected position on said slide block relative to said axis of rotation of said drive means, actuating means for rotating said adjusting screw to move said slide block on said adjusting screw and advance said drive linkage first end portion to a preselected position relative to the axis of rotation of said drive means corresponding to a preselected feed length of the strip material, and means for connecting said actuating means to said adjusting screw at a point positioned on said adjusting screw rotational axis and overlying said axis of rotation of said drive means to permit adjustments to be made in the feed length of the strip material while the strip material is being intermittently fed without said actuating means rotating with said drive means.

* * * * *